United States Patent [19]

Williamson

[11] Patent Number: 5,063,827

[45] Date of Patent: Nov. 12, 1991

[54] MUZZLE BLAST DEFLECTOR

[76] Inventor: Roy Williamson, 8345 Park Byrd Rd., Lakeland, Fla. 33809

[21] Appl. No.: 529,389

[22] Filed: May 29, 1990

[51] Int. Cl.[5] ..... F41A 21/26
[52] U.S. Cl. ..... 89/14.3
[58] Field of Search ..... 89/14.3

[56] References Cited

U.S. PATENT DOCUMENTS

| | | | |
|---|---|---|---|
| 2,184,595 | 12/1939 | Hughes | 89/14.3 |
| 3,492,912 | 2/1970 | Ashbrook | 89/14.3 |
| 3,714,864 | 2/1973 | Thierry | 89/14.3 |
| 4,207,799 | 6/1980 | Tocco | 89/14.3 |

FOREIGN PATENT DOCUMENTS

| | | | |
|---|---|---|---|
| 165364 | 6/1921 | United Kingdom | 89/14.3 |
| 233709 | 1/1926 | United Kingdom | 89/14.3 |

*Primary Examiner*—Stephen C. Bentley
*Attorney, Agent, or Firm*—Macdonald J. Wiggins

[57] ABSTRACT

A muzzle blast deflector for use on a rifle having a recoil arrestor attached to the muzzle. The blast deflector is a metal cone having a central opening for installing on a threaded muzzle barrel. The recoil arrestor is threaded on the muzzle and holds the blast deflector in place. The cone projects forward and beyond gas ports of the arrestor. Expanding gases from the recoil arrestor are deflected forward, preventing shock waves from the gases from traveling toward the shooter.

4 Claims, 1 Drawing Sheet

FIG. 1
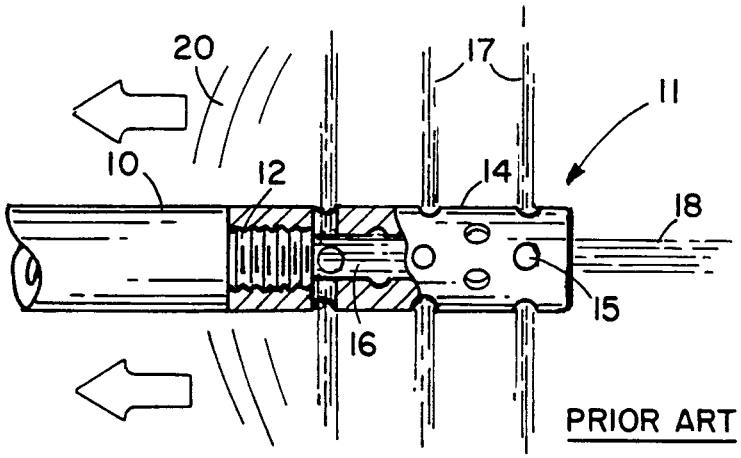
FIG. 2
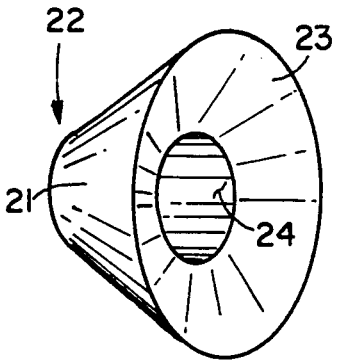
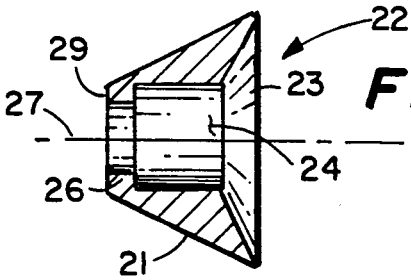
FIG. 3
FIG. 4
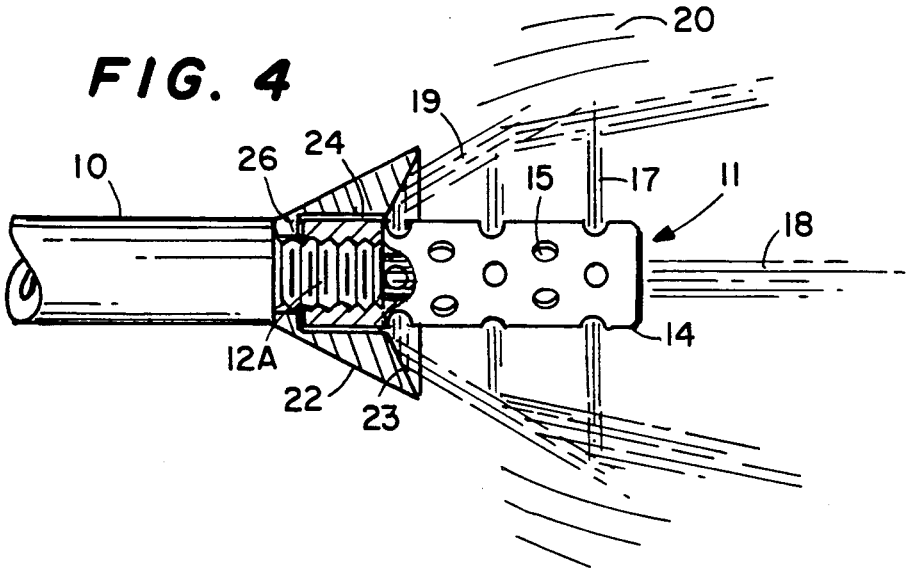

MUZZLE BLAST DEFLECTOR

BACKGROUND OF THE INVENTION

1. Field of the Invention

The present invention relates to a blast deflector for rifles having recoil arrestors, and more particularly to deflector for eliminating the effect on a shooter's ears from the muzzle blast produced by the recoil arrestor.

2. Description of the Prior Art

Hunting enthusiasts commonly utilize rifle recoil arrestors that redirect the expanding gases from the burning powder at an essentially right angle to the rifle barrel, rather than following the same direction as the bullet. However, the exiting gasses produce a blast of sound back toward the shooter. The noise level of such muzzle blast, and the pressure on the eardrums causes significant discomfort. Long time exposure to such blasts may result in damage to the hearing.

Attempts to deflect the muzzle blast have been attempted in the prior art. Known devices have been combinations of a recoil arrestor and a blast deflector. For example, Chahin, U.S. Pat. No. 4,869,151 discloses a straight through barrel and a series of outwardly extending openings. U.S. Pat. No. 2,150,161 to Green, U.S. Pat. No. 3,368,453 to Shaw, and U.S. Pat. No. 1,427,802 to Goodwin all use various flared barrel designs to arrest recoil and reduce muzzle blast. The prior art designs are rather complex and present difficulties in fabrication.

Thus, there is a need for a simple, low cost device that may be used in conjunction with commonly used recoil arrestors for reducing the harmful and uncomfortable effects of the muzzle blast.

SUMMARY OF THE INVENTION

The present invention is a muzzle blast deflector to be used in conjunction with presently available recoil arrestors. FIG. 1 shows a typical prior art recoil arrestor 11 is shown attached to a rifle barrel 10. The barrel 10 has external threads 12 cut into its muzzle. Arrestor 11 includes an internally threaded end that screws over the threaded barrel muzzle. A plurality of openings 15 through the wall of arrestor 11 permit the expanding gasses from the powder to escape at right angles from the barrel 10, as indicated at 17. As exhaust gasses 17 expand in the atmosphere, a shock wave 20 is produced that travels in the direction of the solid arrows toward the shooter.

To prevent or reduce such shock waves toward the shooter, the present invention provides a conical shield that may be installed over the threaded barrel muzzle, and having a cylindrical longitudinal opening for accepting a proximal end of the recoil arrestor. Thus, the arrestor holds the shield securely against the muzzle. The conical shield extends at least beyond a first row of arrestor openings. When gasses exhaust through the arrestor openings, the shield reflects the gas streams forward, causing the shock waves to be directed outward from the muzzle. Any rearwardly moving shock waves are greatly attenuated with respect to the shooter.

It is therefore a principal object of the invention to provide a muzzle blast deflector for a rifle to be used in conjunction with a recoil arrestor to minimized the effect of a muzzle blast on a shooter.

It is another object of the invention to provide a conical deflector that is installable between a rifle barrel muzzle and a recoil arrestor installed on the barrel.

It is still another object of the invention to provide a low-cost, easily installed blast deflector that is held in place on a rifle muzzle by a recoil arrestor.

These and other objects and advantages will become apparent from the following detailed description when read in conjunction with the drawings.

BRIEF DESCRIPTION OF THE DRAWINGS

FIG. 1 is a view of a muzzle portion of a rifle barrel having a typical recoil arrestor installed thereon, partially cut away, and showing the effect of escaping gasses as in the prior art;

FIG. 2 is a perspective view of the blast deflector of the invention;

FIG. 3 is a cross sectional view of the deflector of FIG. 2; and

FIG. 4 is a view of a muzzle portion of a rifle barrel having a typical prior art recoil arrestor installed thereon, partially cut away, with the recoil arrestor of FIG. 2 in cross section, and showing the effect of escaping gasses in reducing rearwardly directed shock waves.

DETAILED DESCRIPTION OF THE PREFERRED EMBODIMENT

FIGS. 2 and 3 provide details of the construction of the blast deflector 22 of the invention. A conical shield 21 includes a front face 23 forming a conical surface having an angle with respect central axis 27 of about 63 degrees. A cylindrical bore 24 extends from front face 23 toward rear face 29 forming circular lip 26. Deflector 22 may be made from any suitable metal, such as steel, aluminum, or the like.

Turning now to FIG. 4, muzzle blast deflector 22 is shown, in cross sectional view, installed on a rifle barrel 10 having a threaded muzzle 26. A typical prior art recoil arrestor 11 is shown partially cut away. Deflector 22 is installed with lip 26 in contact with the muzzle of barrel 10. Arrestor 11 is threaded onto threads 12A, and tightened to secure lip 26 against the muzzle. The body of arrestor 11 fits snugly into bore 24 of deflector 22. As may be noted, the outer edge of conical face 23 extends slightly beyond the first row of openings 15 in arrestor 11. Different brands of recoil arrestors may have differing opening patterns than the exemplary arrestors shown. As will be recognized, the angle of face 23 is selected as required to obtain the desired coverage of openings without interfering with the rifle sights.

As shown in FIG. 4, the gas stream 19, issuing from the first row of openings 15, is deflected by face 23, and serves to deflect the forward gas streams 17. Shock waves 20 now tend to travel at an angle with respect to the barrel axis, and away from the shooter. Tests with the invention have indicated that audible reports are reduced very little, but that blast pressures on the ears is greatly reduced. It is believed that the discomfort experienced with recoil arrestors arises from very low frequency shock waves in the air, rather than the firing report falling within the range of hearing.

It is the practice, in installing prior art recoil arrestors on a rifle barrel, to have a gunsmith to cut threads 12 of FIG. 1 in the muzzle end of the barrel to permit the arrestor to seat against the shoulder created by the threading operation. When the blast deflector of the invention is to be used, the threads 12A will extend, beyond threads 12 of FIG. 1, the thickness of lip 26 to assure proper alignment of face 23 with openings 15.

Although a specific implementation of the invention has been disclosed for exemplary purposes, it is to be understood that various modifications in shape and specific details of the invention may be mad to suit the specific recoil arrestor without departing from the spirit and scope of the invention.

I claim:

1. In a rifle barrel having a threaded muzzle for attachment of a recoil arrestor, said arrestor having a cylindrical body, a bore, a plurality of sets of openings through said body, and a threaded end of said bore, the improvement comprising:

a blast deflector having a shield including a conical rear surface, a conical front surface, a cylindrical central bore, and an annular lip at a small end of said conical rear surface;

wherein said deflector is disposed over said threaded muzzle, said cylindrical body of said arrestor is inserted through said cylindrical central bore, and said body threaded onto said muzzle resulting in an outer forward edge of said deflector extending over at least one set of said openings of said arrestor, thereby securing said deflector on said muzzle.

2. The improvement as defined in claim 1 in which said deflector is formed of aluminum.

3. The improvement as defined in claim 1 in which said deflector is formed of steel.

4. A muzzle blast deflector, for use with a cylindrical recoil arrestor, said arrestor having a threaded bore, and sets of openings around the periphery of an outer surface of said arrestor communicating with said bore, and a rifle having a threaded muzzle, comprising:

a body portion having a conical rear surface and a conical front surface intersecting at outer edges thereof;

said body portion having a central cylindrical bore concentric with said conical surfaces; and an annular lip formed at a rear end of said body portion bore, an opening through said lip having a diameter equal to a diameter of said threaded muzzle;

said deflector to be installed on said threaded muzzle, and said arrestor threaded onto said threaded muzzle to bear against an interior surface of said annular lip, whereby said outer edges of said conical surfaces extend forward and over at least one set of said arrestor openings, and expanding gases from firing of said rifle pass through said set of arrestor openings and are deflected forward by said front conical surface thereby reducing rearwardly directed shock waves from said expanding gases.

* * * * *